US009318825B2

(12) United States Patent
Taguchi et al.

(10) Patent No.: US 9,318,825 B2
(45) Date of Patent: Apr. 19, 2016

(54) CONNECTING STRUCTURE OF CONNECTOR AND TERMINAL FITTING

(71) Applicant: YAZAKI CORPORATION, Tokyo (JP)

(72) Inventors: Naoto Taguchi, Shizuoka (JP); Naokazu Nagasaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/710,827

(22) Filed: May 13, 2015

(65) Prior Publication Data

US 2015/0333427 A1 Nov. 19, 2015

(30) Foreign Application Priority Data

May 15, 2014 (JP) ..... 2014-101039

(51) Int. Cl.

*H01R 13/432* (2006.01)
*H01R 13/11* (2006.01)
*H01R 13/422* (2006.01)
*H01R 13/428* (2006.01)

(52) U.S. Cl.

CPC ..... *H01R 13/113* (2013.01); *H01R 13/428* (2013.01); *H01R 13/4223* (2013.01)

(58) Field of Classification Search

CPC ..... H01R 13/113; H01R 13/428; H01R 13/4223; H01R 13/4362; H01R 13/506; H01R 13/2433; H01R 13/4361; H01R 13/114; H01R 24/62

See application file for complete search history.

(56) References Cited

U.S. PATENT DOCUMENTS 6,354,873 B1 * 3/2002 Morello ..... H01R 13/4362 439/352
6,435,921 B2 * 8/2002 Kojima ..... 439/399
6,482,035 B2 * 11/2002 Okabe ..... H01R 4/2433 439/596
6,533,611 B2 * 3/2003 Morello ..... H01R 13/4361 439/595
6,905,371 B2 * 6/2005 Yi-Tse ..... H01R 24/62 174/72 R
8,215,984 B2 * 7/2012 Yokozeki ..... H01R 13/506 439/540.1
8,795,007 B2 * 8/2014 Itou ..... H01R 13/114 439/852

FOREIGN PATENT DOCUMENTS

JP 2004-14304 A 1/2004

* cited by examiner

*Primary Examiner* — Jean F Duverne
(74) *Attorney, Agent, or Firm* — Kenealy Vaidya LLP

(57) ABSTRACT

A female terminal fitting is provided with a lance hole at a given position in the longitudinal direction of a bottom wall portion thereof, a latching groove of a lance portion formed inside a terminal housing cavity of a connector housing being resiliently inserted into the lance hole, and with a latching protrusion formed at a hole edge portion on the front end side of the lance hole, an end edge of a retaining portion inserted in the lance hole abutting and latching on the latching protrusion. The latching protrusion includes a conical portion gradually expanding its diameter from a vertex on the front side toward a rear end on the hole edge portion side of the lance hole, a cylindrical portion integrally formed at the rear end edge of the conical portion, and a cutout portion with a part of the conical portion is cut out.

7 Claims, 8 Drawing Sheets

CONNECTING STRUCTURE OF CONNECTOR AND TERMINAL FITTING

CROSS-REFERENCE TO RELATED APPLICATION(S)

The present application claims priority to and incorporates by reference the entire contents of Japanese Patent Application No. 2014-101039 filed in Japan on May 15, 2014.

BACKGROUND OF THE INVENTION

1. Field of the Invention

The present invention relates to a connecting structure of a connector and a terminal fitting used for a connection of wire harnesses and the like arranged in a vehicle, for example.

2. Description of the Related Art

As a conventional connecting structure of a connector and a terminal fitting that is electrically coupled within the connector, the one disclosed in Japanese Patent Application Laid-open No. 2004-014304 is known.

Explaining the outline thereof, the connector is provided with a plurality of bored-through terminal housing cavities inside a box-shaped connector housing, and at a given position in the axis direction inside each of the terminal housing cavities, is provided with a lance portion that is resiliently deformable to go in and out.

The terminal fitting is integrally formed by press forming, and includes a main body that is formed in a substantially boxed shape, and a barrel portion that is integrally connected to one end portion of the main body in the longitudinal direction and capable of making the crimping connection to the end of an electrical wire. The main body includes a bottom wall that extends from the front to the rear, a pair of sidewalls, a ceiling wall, and an outer wall that is overlapped with the outside of the ceiling wall.

At substantially the center of a rear-end edge portion in the front portion of the outer wall along the width direction, a latching protrusion that is engageable with the lance portion is formed to bulge outward.

The latching protrusion is formed in a substantially pyramid shape with the front end as a vertex, and includes a pyramid portion that is formed in a tapered shape for which the width dimension and height dimension decrease toward the front end side and composed of three inclined surfaces, and an angular cylindrical portion for which the width dimension and height dimension are constant and composed of three outer surfaces. This latching protrusion is formed in a shape bulging outward from a virtual triangular pyramid formed by connecting the vertex at the front end, a pair of protruding base ends at the rear end edge, and a protruding distal end toward outside.

Consequently, the internal volume of the latching protrusion is increased as compared with that of the virtual triangular pyramid, and thus at the time of engaging with the lance portion, the amount of a retaining portion of the lance portion that is allowed to go into the inner side of the latching protrusion is increased. Hence, because the terminal fitting is pulled toward the rear while the retaining portion is biting into the latching protrusion, the retaining force of the terminal fitting is increased.

In the conventional technology, however, to form the latching protrusion, the end portion of the outer wall is extended, and after forming the latching protrusion of a bulging shape on the extended portion by press forming or the like, the extended portion is formed to bend downward to fold back. Consequently, the forming operation of the latching protrusion is cumbersome, leading to a decrease in the efficiency of the forming operation and a sharp rise in forming cost.

SUMMARY OF THE INVENTION

An object of the present invention is to provide a connecting structure of a connector and a terminal fitting that can make the forming operation of the latching protrusion easy and yield the reduction in forming cost.

According to one aspect of the present invention, in a connecting structure of a connector and a terminal fitting in which the terminal fitting is inserted into a terminal housing cavity formed in a connector housing from one end opening in a longitudinal direction and is latched and connected at a retaining portion formed on an inner wall of the terminal housing cavity, the connecting structure includes a lance hole configured to be formed at a given position of an outer wall of the terminal fitting in the longitudinal direction, the retaining portion being resiliently inserted into the lance hole; and a latching protrusion configured to be formed integrally at a hole edge portion on the front end side of the lance hole, an end edge portion of the retaining portion inserted in the lance hole abutting and latching on the latching protrusion in an axis direction, wherein the latching protrusion is formed in substantially a conical shape for which a diameter gradually expands from a vertex on a front side toward a rear end portion on hole edge portion side of the lance hole, and includes a cutout portion with a part of the latching protrusion from the vertex toward rear end portion side being cut out.

According to another aspect of the present invention, it is possible to further include a contact spring provided on an inner surface facing the latching protrusion of the outer wall; and a contact bead provided on an inner surface on the latching protrusion side facing the contact spring and configured to clamp resiliently a male terminal in cooperation with the contact spring.

According to still another aspect of the present invention, it is possible to configure that the latching protrusion includes a conical portion or a pyramidal portion on an end edge side of the cutout portion on the vertex side, and a cylindrical portion or an angular cylindrical portion extending toward a rear end portion side from the conical portion or the pyramidal portion, respectively.

According to still another aspect of the present invention, it is possible to configure that the terminal housing cavity is formed such that a part of an inner wall surface is formed in a downslope shape toward substantially a central location in an axis direction from the one end opening, and a transverse sectional shape from substantially the central location to an end portion is formed in a similarity shape that is slightly larger than the transverse sectional shape of the terminal fitting.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes in detail exemplary embodiments of a connecting structure of a connector and a terminal fitting according to the present invention based on the accompanying drawings. The embodiments are the ones that the invention is applied to connectors and terminal fittings that connect wire harnesses connected to electrical equipment of a vehicle.

First Embodiment

Figure 1:
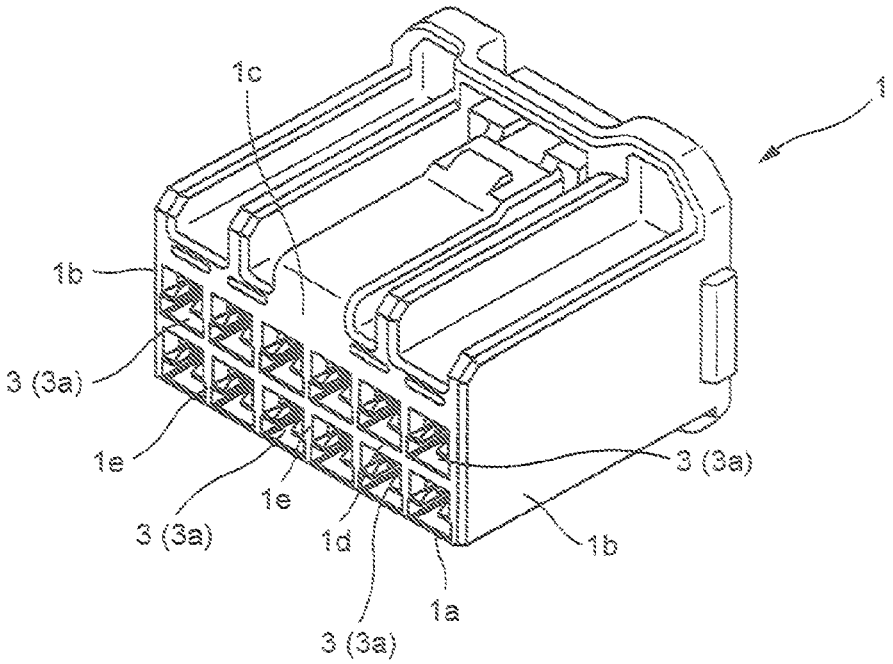
FIG. 1 is a perspective view illustrating a connector housing of a connecting structure of a connector and a terminal fitting provided in a first embodiment.
Figure 2:
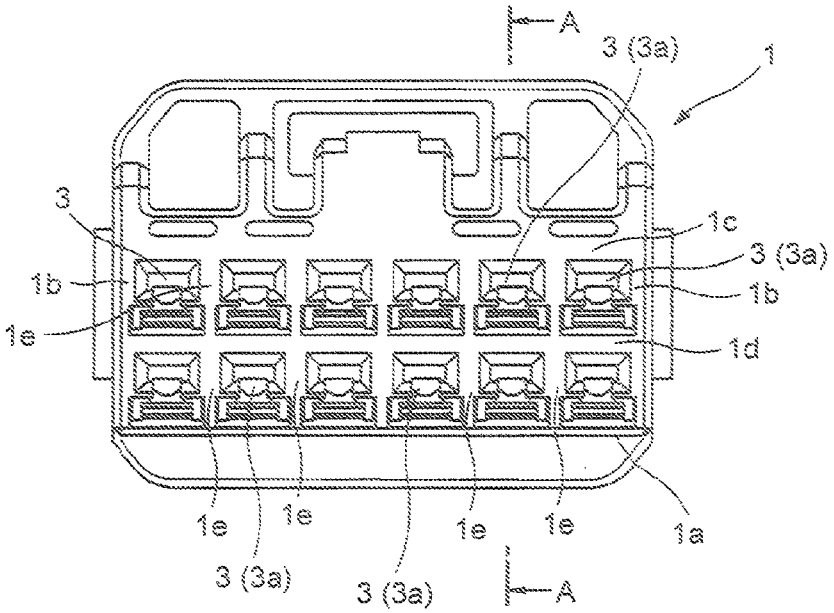
FIG. 2 is a front view of the connector housing.

Explaining specifically, as illustrated in FIGS. 1 and 2, the connector includes a box-shaped connector housing 1 having a plurality of terminal housing cavities 3 inside. Meanwhile, the terminal fittings are composed of a plurality of female terminal fittings 2 that are inserted to the inside of the respective terminal housing cavities 3 of the connector housing 1 from one side in the axis direction and secured therein.

Figure 3:
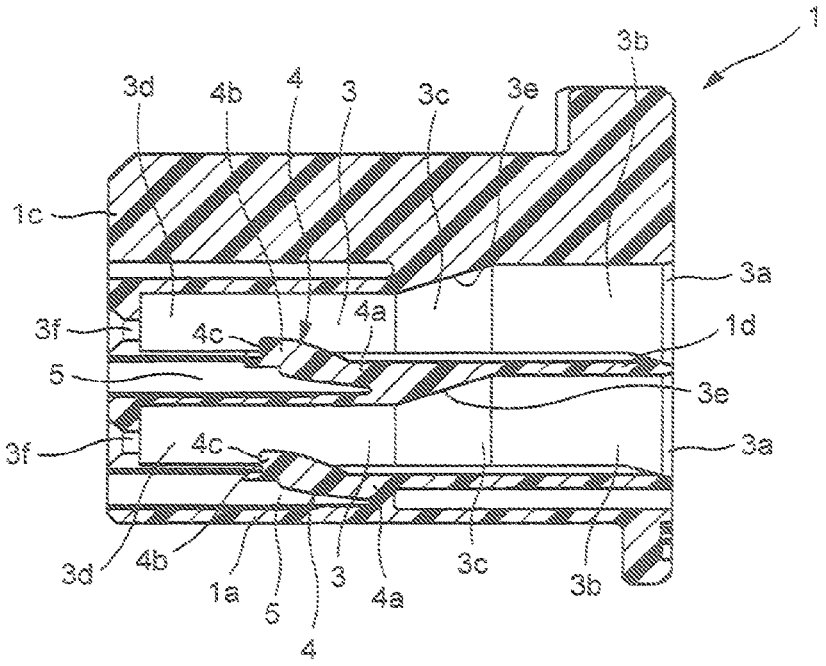
FIG. 3 is a sectional view viewed along the A-A line in FIG. 2.
Figure 4:
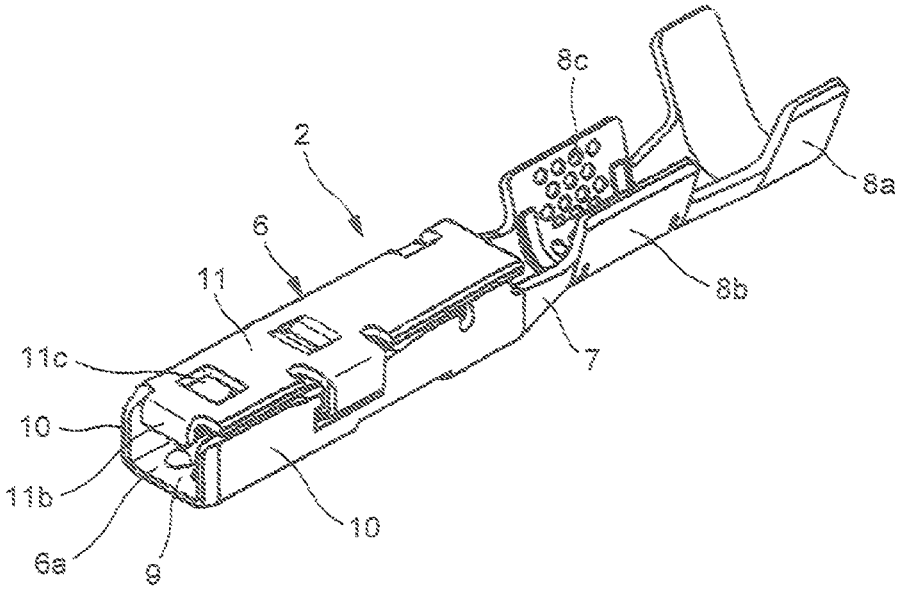
FIG. 4 is a perspective view of a female terminal fitting provided in the first embodiment viewed from above.

The connector housing 1, as illustrated in FIGS. 1 to 3, is integrally formed of synthetic resin material, and includes a flat bottom wall 1*a*, sidewalls 1*b* and 1*b* integrally rising from both side edges of the bottom wall 1*a*, a relatively thick upper wall 1*c* integrally provided at upper end edges of the sidewalls 1*b* and 1*b*, an intermediate wall 1*d* formed between the bottom wall 1*a* and the upper wall 1*c*, and five partition walls 1*e* connecting the bottom wall 1*a*, the upper wall 1*c*, and the intermediate wall 1*d* in the vertical direction. Inside the connector housing 1, a total of 12 terminal housing cavities 3 in two stages of top and bottom defined with the respective walls 1*a* to 1*e* are bored through along the axis direction.

Each of the terminal housing cavities 3 is formed in a substantially rectangular shape in transverse cross-section and, as illustrated in FIG. 3, includes a first housing cavity 3*b* extending from one end opening 3*a* up to the one third in the internal axis direction, a second housing cavity 3*c* extending from the end side of the first housing cavity 3*b* up to a substantially central location in the internal axis direction, and a third housing cavity 3*d* extending from the end side of the second housing cavity 3*c* up to near the end portion of the terminal housing cavity.

The first housing cavity 3*b* is formed having a relatively large sectional area by cutting out a ceiling wall surface of the upper wall 1*c* or the intermediate wall 1*d*. The second housing cavity 3*c* is formed such that a ceiling wall surface 3*e* of the upper wall 1*c* or the intermediate wall 1*d* has, from the end edge of the first housing cavity 3*b* up to substantially a central location in the axis direction, a tapered surface in a downslope shape in a direction toward the end portion of the terminal housing cavity 3. The third housing cavity 3*d* is formed such that the sectional area thereof is slightly larger than that of a later described terminal main body 6 of the female terminal fitting 2 so that the terminal main body 6 can be stably inserted.

At the end portion of the terminal housing cavity 3, that is, the end portion of the third housing cavity 3*d*, an insertion through-hole 3*f* into which a male terminal 16 of a later described male terminal fitting can be inserted is bored through in the axis direction.

In respective regions of the bottom wall 1*a* and the intermediate wall 1*d* at which the third housing cavity 3*d* is located, lance portions 4 that are retaining portions are integrally formed.

Figure 8:
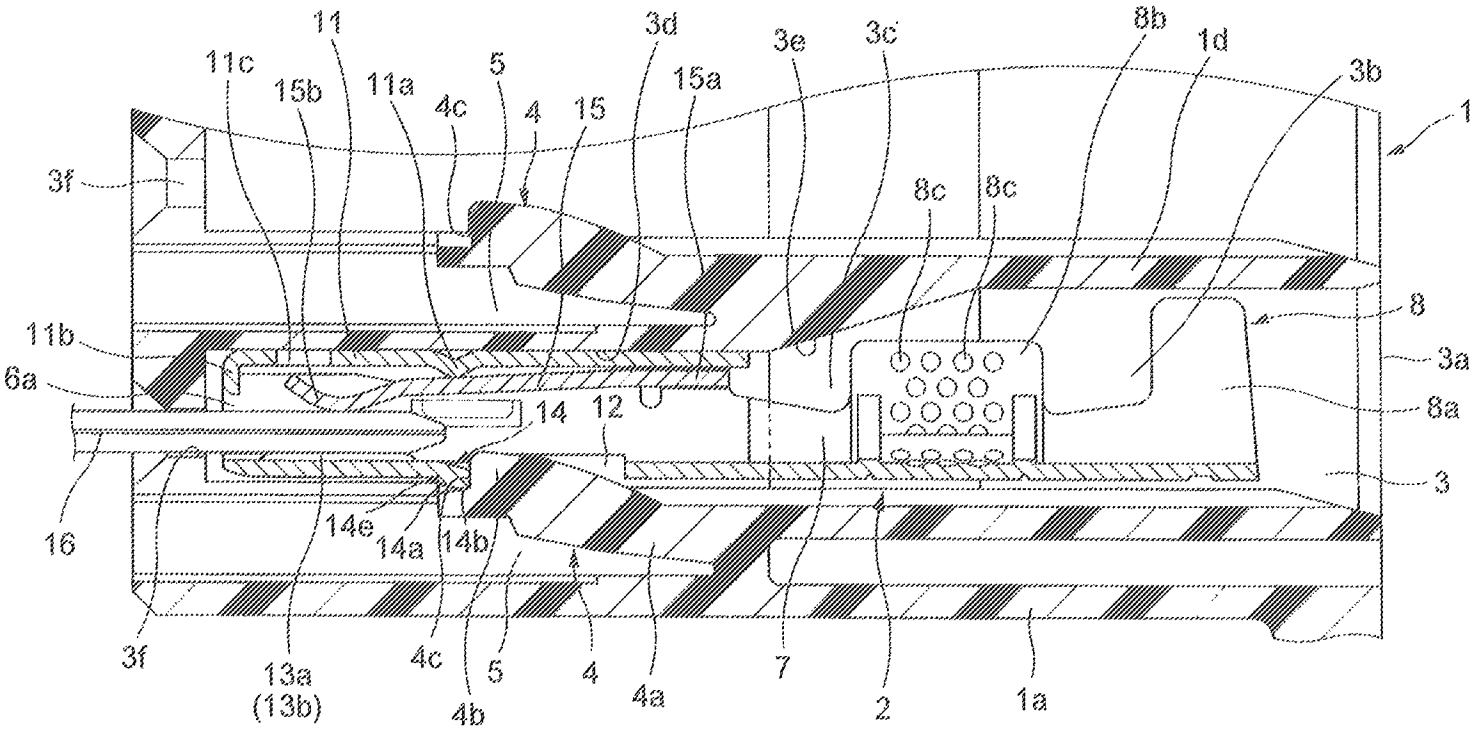
FIG. 8 is a longitudinal sectional view illustrating a state in which the female terminal fitting is normally inserted and connected in a terminal housing cavity of the connector housing.

The respective lance portions 4 are integrally formed when the connector housing 1 is formed in resin molding and, as illustrated in FIGS. 3 and 8, are in an upward inclined shape cut and raised from a void portion 5 formed in the lower portion of the bottom wall 1*a* or the intermediate wall 1*d* on the end side and formed to be resiliently deformable in the vertical direction with the void portion 5. That is, in each of the lance portions 4, a base end portion 4*a* is positioned near the end portion of the second housing cavity 3*c* and an end portion 4*b* is formed in an upslope shape toward the insertion through-hole 3*f* from the base end portion 4*a*, so that the end portion 4*b* resiliently deforms in the vertical direction via the cut-out void portion 5 with the base end portion 4*a* as a fulcrum.

In the end portion 4*b*, the end edge is formed in a stepped shape being cut out in substantially a reversed L-shape in FIG. 8, and a latching groove 4*c* in this stepped shape latches an end portion of a later described latching protrusion 14.

The female terminal fitting 2, as illustrated in FIGS. 4 to 7, is integrally formed by applying bending and folding by press forming to a metal plate of copper or copper alloy as conductive material, and includes the terminal main body 6 that is formed in substantially a box shape on the end side and a barrel portion 8 that is integrally connected to the rear end side of the terminal main body 6 via a connecting portion 7 to be connected to the end of an electrical wire by crimping.

The terminal main body 6 is formed by folding the metal plate in substantially a rectangular shape in transverse cross-section and formed in an angular cylindrical shape longer in the front-back direction, and includes a bottom wall portion 9 extending in the front-back direction, a pair of sidewall portions 10 and 10 rising substantially perpendicularly from both side edges of the bottom wall portion 9, and an upper wall portion 11 provided on the upper end edges of both sidewall portions 10 and 10, and a whole of the respective wall portions 9 to 11 constitutes the outer wall.

In the terminal main body 6, an opening 6*a* into which the male terminal 16 of a male terminal fitting is inserted through is formed at the end portion defined with the respective wall portions 9 to 11.

The bottom wall portion 9 is formed in a flat shape, and a rectangular-shaped lance hole 12 into which the end portion 4*b* of the lance portion 4 of the connector housing 1 is inserted to latch is formed on the rear end portion side in the longitudinal direction, and a pair of left-right contact beads 13*a* and 13*b* that contact with the male terminal 16 of a later described male terminal fitting, which is inserted to the inside from the opening 6*a*, is formed in the front end portion to be elongated and in parallel along the longitudinal direction. The contact beads 13*a* and 13*b* are formed by pressing the bottom wall portion 9 from the outside toward the inside by a pressing machine and are formed in substantially an arc shape in transverse cross-section.

On a hole edge portion 12*a* side that is on the front end side of the lance hole 12 of the bottom wall portion 9, the latching protrusion 14 that engages with the latching groove 4*c* of the lance portion 4 in the front-back direction is integrally formed.

Figure 5A:
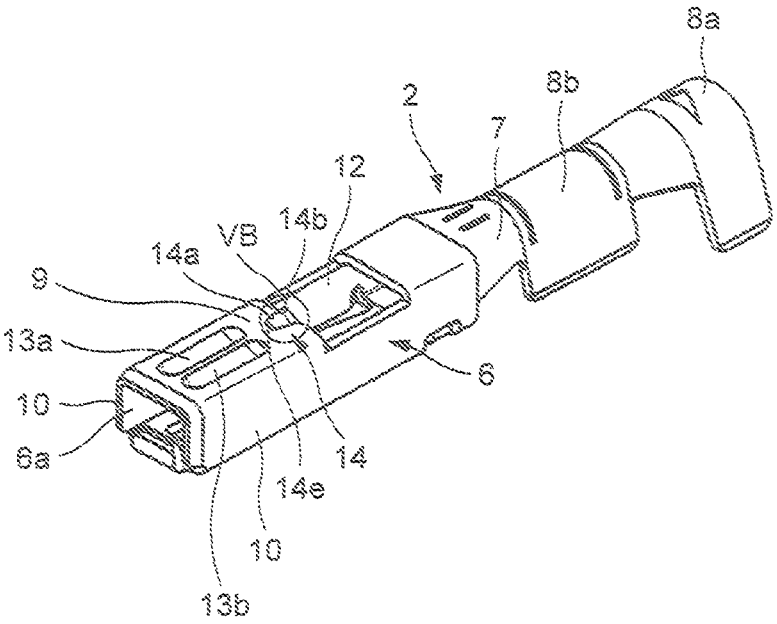
FIG. 5A is a perspective view of the female terminal fitting viewed from below.
Figure 5B:
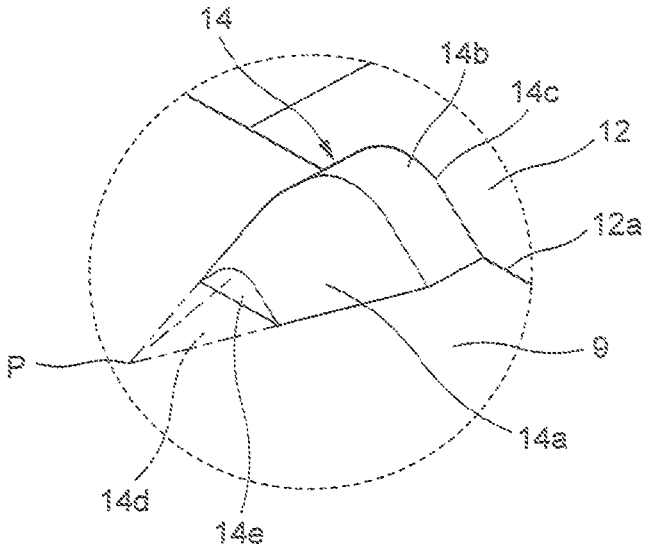
FIG. 5B is an enlarged view of the B portion in FIG. 5A.
Figure 6:
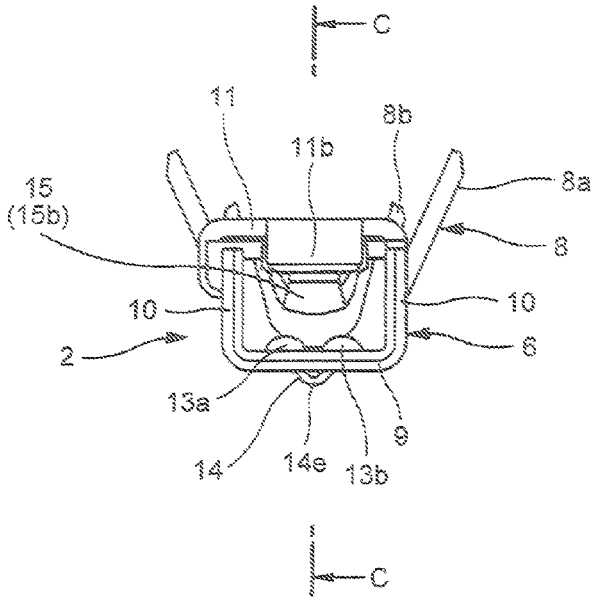
FIG. 6 is a front view of the female terminal fitting.

This latching protrusion 14, as illustrated in FIGS. 5A and 5B, is formed in substantially a central location in the width direction of the lance hole 12 of the bottom wall portion 9, is formed by pressing the hole edge portion 12*a* of the lance hole 12 outward (downward) from the inside by a pressing machine so as to deform in a bulging manner, and includes a conical portion (semi-conical portion) 14*a* that is formed in a shape for which the diameter gradually expands from a vertex (virtual point P) on the front end side up to near the hole edge portion 12*a* of the lance hole 12 and a cylindrical portion (semi-cylindrical portion) 14*b* that is formed in the same diameter from the end edge of the conical portion 14*a* to the rear end portion.

In the cylindrical portion 14*b*, an end edge 14*c* is formed on substantially the same plane as the end edge of the hole edge portion 12*a* of the lance hole 12, and the end edge 14*c* latches the latching groove 4*c* of the lance portion 4.

While the conical portion 14*a* is formed in a shape for which the diameter gradually expands from the vertex P in a direction toward the cylindrical portion 14*b* at a given angle, a part of the region on the vertex P side is formed being cut out. This cutout portion 14*d* is cut out from the vertex P to the position of approximately one fourth of the conical portion 14*a*, and its cutting surface 14*e* is formed substantially perpendicular to the outer bottom surface of the bottom wall portion 9.

Figure 7:
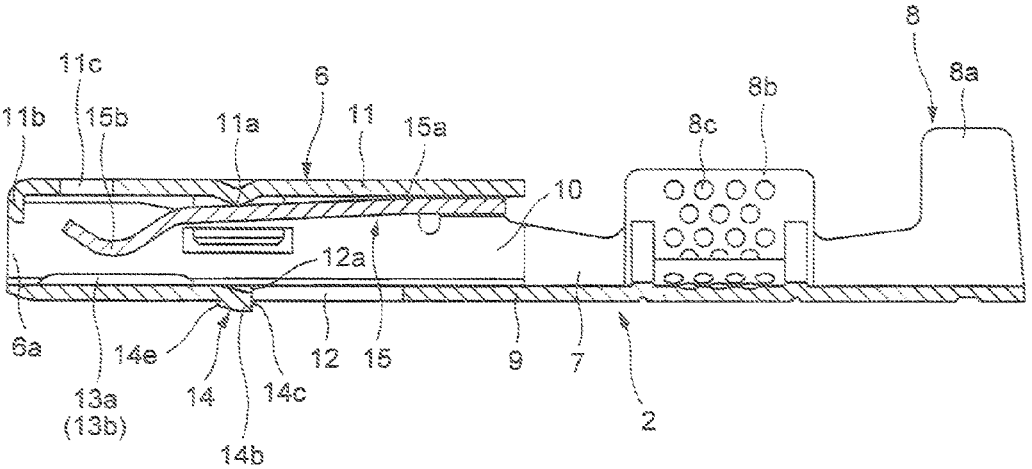
FIG. 7 is a sectional view viewed along the C-C line in FIG. 6.

The upper wall portion 11, as illustrated in FIG. 7, is formed in parallel with the bottom wall portion 9, and at the lower surface (ceiling surface), a contact spring 15 that resiliently clamps the male terminal 16 of the male terminal fitting in cooperatively with both contact beads 13*a* and 13*b* is integrally provided.

The contact spring 15 is formed in an elongated plate spring shape, and a base portion 15*a* is joined to the ceiling surface of the upper wall portion 11 and an end portion 15*b* is formed in a curved form to ensure good insertion of the male terminal 16 of the male terminal fitting. The contact spring 15 resiliently contacts with a protrusion 11*a* provided to protrude on the lower surface of the upper wall portion 11 at the upper surface between the base portion 15*a* and the end portion 15*b* and is resiliently deformed in a downslope shape from the base portion 15*a* toward the end portion 15*b*, and the end portion 15*b* is deformable in the vertical direction with the protrusion 11*a* as a fulcrum.

The upper wall portion 11 is integrally provided at the end portion with a guiding protrusion piece 11*b* that guides to insert the male terminal 16 of the male terminal fitting from the opening 6*a* to the inside. On the further inner side of the guiding protrusion piece 11*b* of the upper wall portion 11, an absorption hole 11*c* is bored through to absorb the maximum deformation of the end portion 15*b* of the contact spring 15 when the end portion 15*b* is resiliently deformed in the direction of the upper wall portion 11 with the protrusion 11*a* as a fulcrum.

The barrel portion 8 has a pair of U-shaped crimping pieces 8*a* and 8*b* in the front and back, and the crimping piece 8*a* on the back side crimps and secures the core wire of an electrical wire not depicted while the crimping piece 8*b* on the front side crimps and secures the sheathing portion of the electrical wire.

On the inner surface of the crimping piece 8*b* on the front side, a plurality of grooved holes 8*c* that increase the frictional force with the sheathing portion of the electrical wire are integrally provided.

Operation in First Embodiment

To insert each of the female terminal fittings 2 into the respective terminal housing cavities 3 of the connector housing 1 to connect therein, hold the female terminal fitting 2, insert the end portion of the terminal main body 6 from the one end opening 3*a* of the terminal housing cavity 3 into the inside of the first housing cavity 3*b*, and press it in as is. By doing so, the terminal main body 6 is inserted while sliding from the second housing cavity 3*c* to the inside of the third housing cavity 3*d*, and when the lower end edge of the latching protrusion 14 on the bottom wall portion 9 of the terminal main body 6 slides along the sloped upper surface of the lance portion 4 while pressing against the elastic force of the lance portion 4, the lance portion 4 is absorbed in the void portion 5 via the lance hole 12 while resiliently deforming downward. Subsequently, when the latching protrusion 14 reaches the latching groove 4*c* of the lance portion 4, the lance portion 4 is inserted to latch into the lance hole 12 by the upward elastic return force of the lance portion 4 itself, and at the same time, the latching groove 4*c* latches the end edge 14*c* of the latching protrusion 14 (see FIG. 8).

Consequently, the female terminal fitting 2 is firmly connected and secured inside the terminal housing cavity 3, and thus it never comes off carelessly even when a force in the direction of coming-off from the terminal housing cavity 3 is exerted.

In FIG. 8, the respective crimping pieces 8*a* and 8*b* of the barrel portion 8 are not in a state of the core material or the sheath portion of the electrical wire being connected by crimping. In practice, however, the female terminal fitting 2 is inserted and secured to the terminal housing cavity 3 in a state that the core material and sheath portion of the electrical wire are crimped in the barrel portion 8 in advance.

After each of the female terminal fittings 2 is inserted and secured to the respective terminal housing cavities 3, as illustrated in FIG. 8, when the male terminal 16 of the male terminal fitting is inserted to the inside of the terminal main body 6 from the insertion through-hole 3*f* of the terminal housing cavity 3 via the end opening 6*a* of the female terminal fitting 2 and pressed in against the elastic reaction force of the end portion 15*b* of the contact spring 15, the upper and lower surfaces of the male terminal 16 are held in a clamped state by the elastic force between the lower surface of the end portion 15*b* and two of the contact beads 13*a* and 13*b* of the bottom wall portion 9.

As in the foregoing, in the first embodiment, the latching protrusion 14 is not formed by folding back the end portion of the bottom wall portion 9 of the terminal main body 6 as in the conventional manner but formed only by simply pressing the front end hole edge portion of the lance hole 12 by a pressing machine, and thus the forming operation is easy, the efficiency of such forming operation is improved, and cost can be reduced.

Moreover, the latching protrusion 14 is shortened in the axis direction by the cutout portion 14*d* on the end portion side of the conical portion 14*a*, and thus the length of the respective contact beads 13*a* and 13*b* can be made longer in the axis direction for the conical portion 14*a* being shortened.

Figure 9:
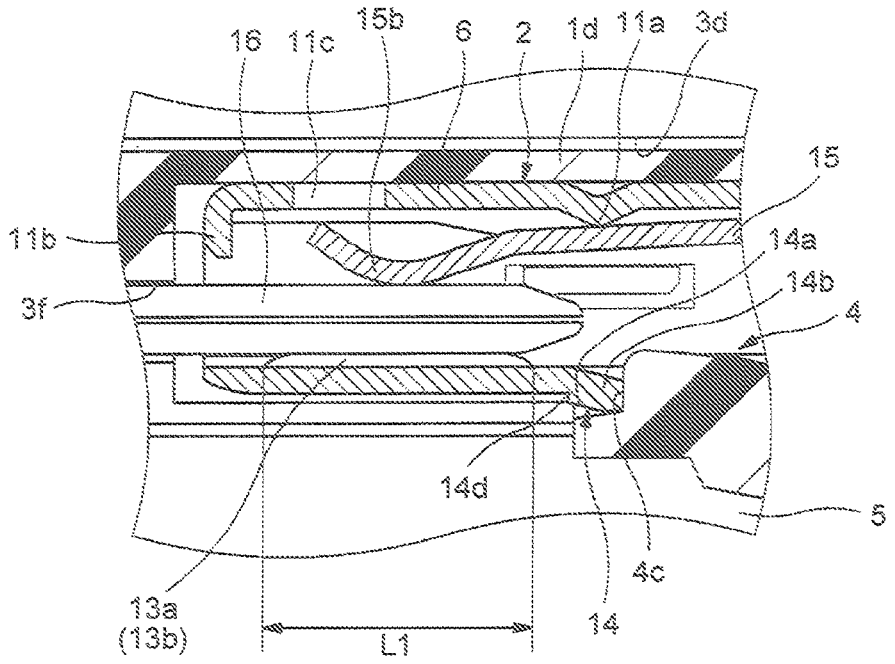
FIG. 9 is an enlarged sectional view illustrating a contact bead in the first embodiment.
Figure 10:
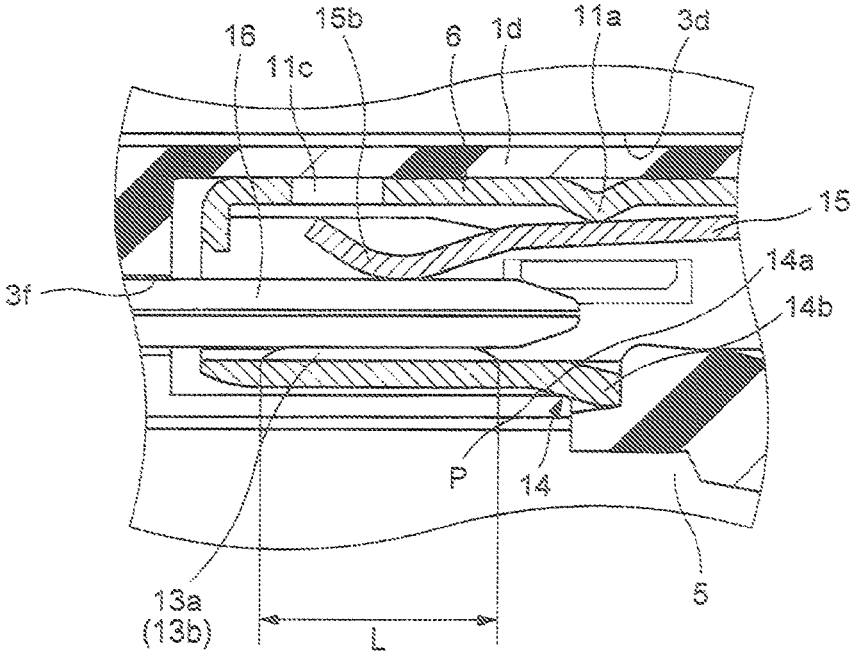
FIG. 10 is an enlarged sectional view illustrating the length of the contact bead in comparison when the end portion of a latching protrusion in the first embodiment is not cut out.

That is, when the conical portion 14*a* of the latching protrusion 14 is formed long in the axis direction up to the vertex P as illustrated in FIG. 10, the length L of the contact beads 13*a* and 13*b* is shortened for that. However, as in the first embodiment as illustrated in FIG. 9, when a part of the conical portion 14*a* on the end portion side of the latching protrusion 14 is cut out, the space for forming the contact beads 13*a* and 13*b* is increased for that, and the length L1 of the contact beads 13*a* and 13*b* in the axis direction can be made longer than the length L.

As a result, the area of contact between the upper surfaces of the contact beads 13*a* and 13*b* and the lower surface of the male terminal 16 is increased, and thus the male terminal 16 can further be retained by this frictional resistance and the conductivity between the female terminal fitting 2 and the male terminal fitting is improved.

Figure 11:
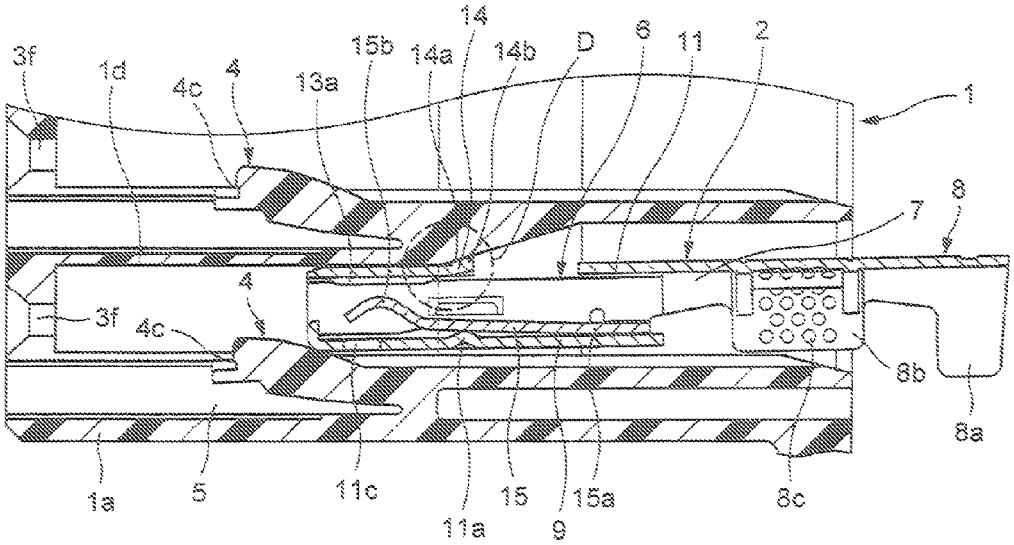
FIG. 11 is a longitudinal sectional view illustrating a state in which the female terminal fitting is wrongly inserted in the terminal housing cavity in the first embodiment.
Figure 12:
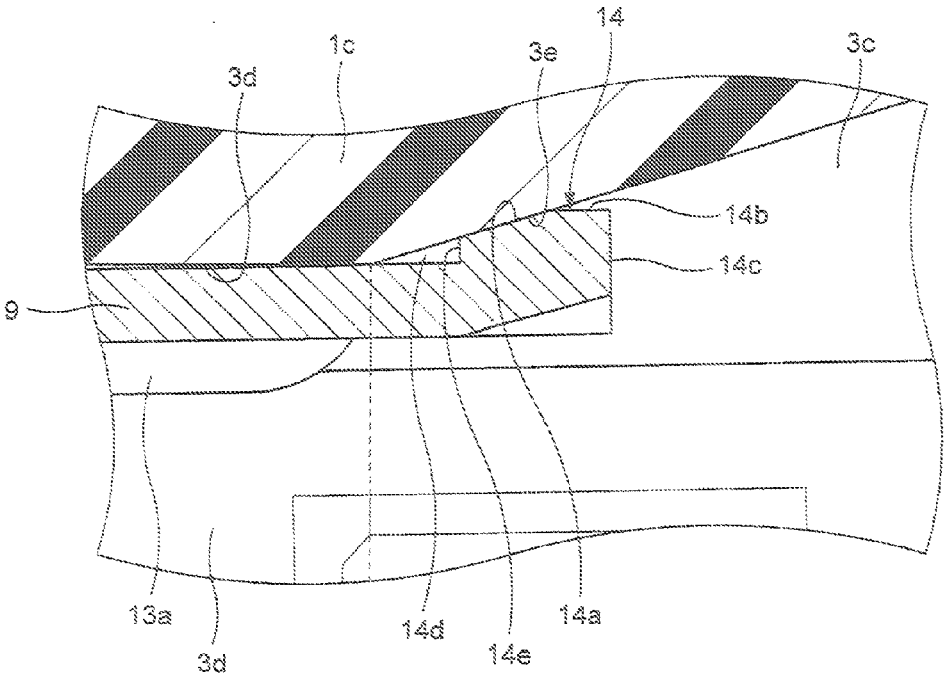
FIG. 12 is an enlarged view of the D portion in FIG. 11.

In accordance with the first embodiment, when the female terminal fitting 2 is inserted upside down erroneously at the time of inserting the female terminal fitting 2 into the terminal housing cavity 3 as in the foregoing, as illustrated in FIGS. 11 and 12, the end portion of the terminal main body 6 passes the one end opening 3*a* and the first housing cavity 3*b* for which the respective opening areas are large. However, when the end portion of the terminal main body 6 tries to enter the third housing cavity 3*d* while the upper end edge of the conical portion 14*a* of the latching protrusion 14 slides on the tapered ceiling wall surface 3*e* in the second housing cavity 3*c*, the upper end edge of the conical portion 14*a* is brought into contact with the end portion of the ceiling wall surface 3*e* (near the third housing cavity 3*d*) and the further insertion is restricted.

As a consequence, an inserting operator can recognize the erroneous assembly of the female terminal fitting 2, and thus the erroneous assembly can be prevented.

In particular, in the first embodiment, because the conical portion 14*a* on the end portion side is cut out, when the terminal main body 6 is inserted, as illustrated in FIG. 12, the upper end edge of the cutting surface 14*e* of the cutout portion 14*d* latches the end portion of the ceiling wall surface 3*e* as biting into it, and thus the effect of restricting the insertion is increased and the erroneous assembly can be recognized further clearly.

Second Embodiment

Figure 13:
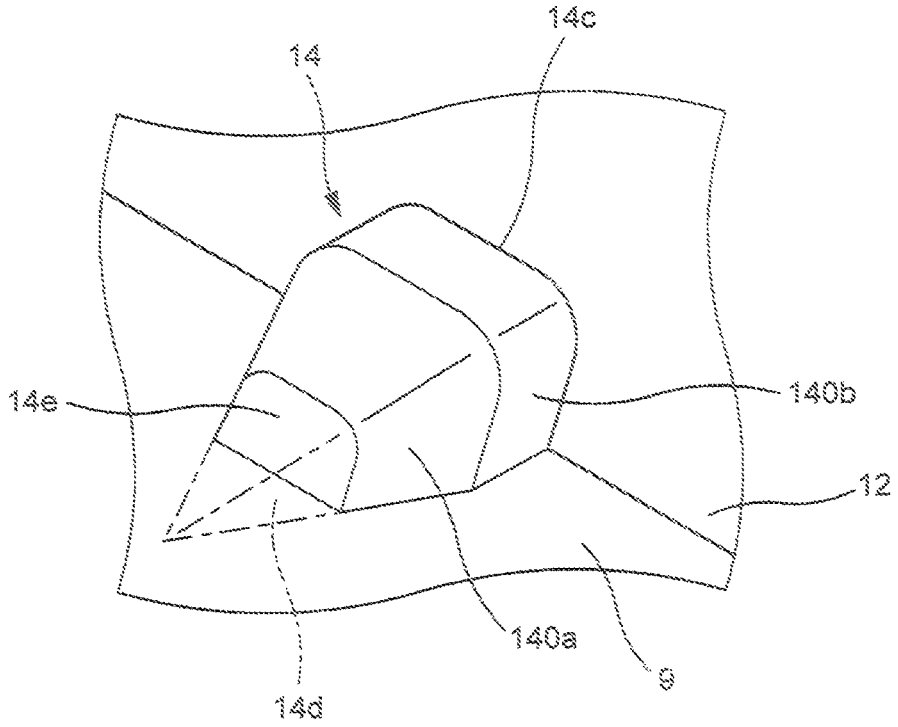
FIG. 13 is an enlarged view of a relevant portion illustrating a second embodiment.

FIG. 13 illustrates a second embodiment, and in the second embodiment, the latching protrusion 14 is formed in a pyramidal shape. That is, the latching protrusion 14 includes a pyramidal portion 140*a* and an angular cylindrical portion 140*b* integrally formed at the rear end edge of the pyramidal portion 140*a*, and as the same as those of the first embodiment, the cutout portion 14*d* is formed on the end portion of the pyramidal portion 140*a* and the length of the pyramidal portion 140*a* in the axis direction is shortened.

The other constituent elements are the same as those of the first embodiment, and thus the same operation and effect as those of the first embodiment, such as being able to increase the length of the contact beads 13*a* and 13*b* in the axis direction, can be obtained. In particular, in the second embodiment, by being formed as the angular cylindrical portion 140*b*, the area of contact between the end edge of the angular cylindrical portion 140*b* and the latching groove 4*c* of the lance portion 4 is increased at the time of abutting and the engaging force is further increased.

Furthermore, by being formed as the pyramidal portion 140*a*, the breadth of the end edge 14*c* of the pyramidal portion 140*a* is increased, and thus the biting performance into the ceiling wall surface 3*e* at the time of erroneous assembly is enhanced and the state of erroneous assembly can be recognized more clearly.

The present invention is not limited to the configuration of the foregoing embodiments, and depending on the specifications of the connector, it is possible to define the female terminal fitting 2 as a male terminal fitting.

According to one aspect of the present invention, the latching protrusion is provided on a flat portion simply without folding back the outer wall of the terminal main body, and thus the forming operation of the latching protrusion is made easy, whereby the efficiency in forming operation can be improved and the reduction in forming cost can be yielded.

Although the embodiment of the present invention has been described, the embodiment is presented as an example and has no intention of limiting the scope of the invention. The above embodiment can be embodied in other various forms, and various omissions, substitutions, or changes can be made thereto without departing from the essence of the invention. The above embodiment and modifications thereof are included in the scope and essence of the invention, and similarly, included in the inventions described in the claims and the scope of equivalents thereof.

What is claimed is:

1. A connecting structure of a connector and a terminal fitting in which the terminal fitting is inserted into a terminal housing cavity formed in a connector housing from one end opening in a longitudinal direction and is latched and connected at a retaining portion formed on an inner wall of the terminal housing cavity, the connecting structure comprising:

a lance hole configured to be formed at a given position of an outer wall of the terminal fitting in the longitudinal direction, the retaining portion being resiliently inserted into the lance hole; and a latching protrusion configured to be formed integrally at a hole edge portion on the front end side of the lance hole, an end edge portion of the retaining portion inserted in the lance hole abutting and latching on the latching protrusion in an axis direction, wherein the latching protrusion is formed in substantially a conical shape for which a diameter gradually expands from a vertex on a front side toward a rear end portion on hole edge portion side of the lance hole, and includes a cutout portion with a part of the latching protrusion from the vertex toward rear end portion side being cut out.

2. The connecting structure of a connector and a terminal fitting according to claim 1, further comprising:

a contact spring provided on an inner surface facing the latching protrusion of the outer wall; and a contact bead provided on an inner surface on the latching protrusion side facing the contact spring and configured to clamp resiliently a male terminal in cooperation with the contact spring.

3. The connecting structure of a connector and a terminal fitting according to claim 1, wherein the latching protrusion includes a conical portion or a pyramidal portion on an end edge side of the cutout portion on the vertex side, and a cylindrical portion or an angular cylindrical portion extending toward a rear end portion side from the conical portion or the pyramidal portion, respectively.

4. The connecting structure of a connector and a terminal fitting according to claim 2, wherein the latching protrusion includes a conical portion or a pyramidal portion on an end edge side of the cutout portion on the vertex side, and a cylindrical portion or an angular cylindrical portion extending toward a rear end portion side from the conical portion or the pyramidal portion, respectively.

5. The connecting structure of a connector and a terminal fitting according to claim 1, wherein the terminal housing cavity is formed such that a part of an inner wall surface is formed in a downslope shape toward substantially a central location in an axis direction from the one end opening, and a transverse sectional shape from substantially the central location to an end portion is formed in a similarity shape that is slightly larger than the transverse sectional shape of the terminal fitting.

6. The connecting structure of a connector and a terminal fitting according to claim 2, wherein the terminal housing cavity is formed such that a part of an inner wall surface is formed in a downslope shape toward substantially a central location in an axis direction from the one end opening, and a transverse sectional shape from substantially the central location to an end portion is formed in a similarity shape that is slightly larger than the transverse sectional shape of the terminal fitting.

7. The connecting structure of a connector and a terminal fitting according to claim 3, wherein the terminal housing cavity is formed such that a part of an inner wall surface is formed in a downslope shape toward substantially a central location in an axis direction from the one end opening, and a transverse sectional shape from substantially the central location to an end portion is formed in a similarity shape that is slightly larger than the transverse sectional shape of the terminal fitting.

* * * * *